United States Patent [19]

Bouru

[11] 4,239,451

[45] Dec. 16, 1980

[54] DEVICE TO FASTEN A SEAL TO THE GUIDE VANES OF A TURBINE ENGINE

[75] Inventor: Michel A. Bouru, Moissy Cramayel, France

[73] Assignee: Societe Nationale d'Etude et de Construction de Moteurs d'Aviation, Paris, France

[21] Appl. No.: 43,612

[22] Filed: May 30, 1979

[30] Foreign Application Priority Data

Jun. 1, 1978 [FR] France ..... 78 18973

[51] Int. Cl.[3] ..... F01D 11/08

[52] U.S. Cl. ..... 415/170 R; 415/170 A

[58] Field of Search ..... 415/170 R, 189, 199.5, 415/172 A

[56] References Cited

U.S. PATENT DOCUMENTS

| | | | |
|---|---|---|---|
| 2,812,159 | 11/1957 | Krebs | 415/172 A |
| 2,962,809 | 12/1960 | Short et al. | 415/170 R |
| 3,501,246 | 3/1970 | Hickey | 415/170 R |
| 3,941,500 | 3/1976 | Glenn | 415/172 A |
| 4,127,357 | 11/1978 | Patterson | 415/170 R |

*Primary Examiner*—Philip R. Coe
*Assistant Examiner*—Timothy F. Simone
*Attorney, Agent, or Firm*—Bacon & Thomas

[57] ABSTRACT

The invention concerns the fastening of a gasket to the inner flange of a distributor of a turbine engine. According to the invention, a ring support has a flange which in turn has a plurality of cutouts arranged to coincide with corresponding cutouts provided in the flange of the distributor. U-shaped clips hold the two flanges together by embracing of the flanges at edges of the cutouts and at the level of the cutouts and are retained in place by a latch.

6 Claims, 7 Drawing Figures

DEVICE TO FASTEN A SEAL TO THE GUIDE VANES OF A TURBINE ENGINE

BACKGROUND OF THE INVENTION

The present invention concerns a device for fastening a seal to the guide vanes of a turbine engine.

Turbine guide vanes consisting of sections comprising several blades cast in clusters and fastened by their roots to the casing of the turbine engine, while their heads form an internal flange to which a ring carrying a seal is fastened, said seal cooperating with the teeth of a rotor to form a labyrinth seal, are known.

In a known manner, rings are fastened to the internal flange by means of bolts, but because of the high thermal stresses to which the fasteners are submitted, it is necessary to use large diameter bolts and the corresponding nuts are subjected to considerable heating in the turbulence generated by the proximity of the teeth of the rotor.

The excessive size of the bolts resulting from the above-described condition generates turbulence in the fastening zones, which is detrimental to the fluid flow in the guide vanes. Furthermore, the loss of a bolt would have catastrophic consequences for the operation of the turbine engine.

SUMMARY OF THE INVENTION

It is an object of the present invention to replace fastening by means of bolts by a fastening method using clips.

According to the present invention, the ring carrying the seal comprises a radial wing resting against the internal flange of the guide vanes and being provided with cutouts arranged so as to coincide with corresponding cutouts provided in the flange wherein U shaped clips engage, securing together along the opposing edges of the cutouts, the radial wing of the seal and the internal flange, said clips being maintained in place by a locking device arranged between said clips and resting with its opposing faces against the backs of the clips, the retention of the locking device being assured by resilient fastener in the form of Ω engaged and secured in a recess of the locking device and resting with its wings against the lateral faces of the clips.

This disposition substantially decreases the turbulence in the fastener zones generated in the generally known devices by the excessive size of said bolts. It also eliminates the disadvantages resulting from the loss of bolts.

BRIEF DESCRIPTION OF THE DRAWINGS

Other characteristics and advantages of the invention will be better understood by reading the description following hereinbelow of the several modes of embodiment, having reference to the drawings attached hereto, wherein.

DESCRIPTION OF THE PREFERRED EMBODIMENTS

Figure 1:
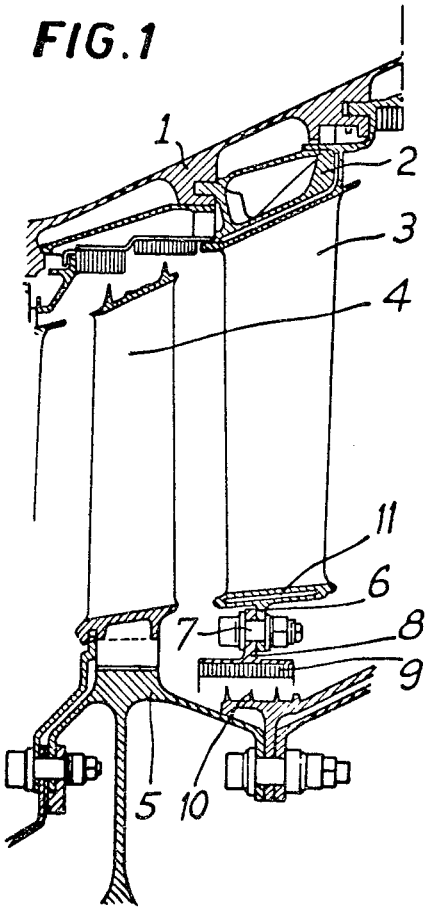
FIG. 1 is a view in axial section of a part of a turbine engine guide vanes of the known type.

In FIG. 1, a turbine of a turbine engine of the known type is shown partially, said turbine comprising a casing 1 to which the blades 3 of a guide vanes are fastened, by their roots 2, said guide vanes being associated in a known manner with a rotor, the vanes whereof being fastened by their feet to a drum 5. The guide vanes consists of sectors comprising several blades 3 interconnected by means of a collar 11 forming an inner flange 6 whereupon by means of bolts 7 a ring 8 carrying a seal 9 is secured, said gasket cooperating with the teeth 10 of the drum 5 of the rotor. The seal consists of a ring made of a material designated "abradable" (generally highly aeriated—honeycomb—porous) capable of wearing off very easily when in contact with the much harder rotating parts of the rotor. Such a fastening device presents a number of disadvantages related to the use of the bolts 7; these are replaced by the fastening device according to the invention, as shown in FIGS. 2, 3 and 4.

On the inner flange 6, which is integral with the blades 3 of the guide vanes, cutouts 12 are provided, said cutouts being arranged to coincide with corresponding cutouts 13 machined into a radial wing 14 of a ring 15 carrying a seal 16.

Two U shaped clips 17 and 17*a* engage in the cutouts 12 and 13, thus securing the radial wing 14 of the ring 15 and the inner flange 6 against each other at the opposing edges of the cutouts, said clips being retained in place by a locking device 18 arranged between said clips and resting with its opposing faces against the backs 19, 19*a* of the clips 17, 17*a*. The locking device 18 has a recess 20 wherein resilient fastener of Ω shape is arranged, 21, and fastened to the bottom of the recess at 20*a* by welding, said fastener 21 having wings 22, 22*a*, resting against the lateral faces 23, 23*a* of the clips 17, 17*a*.

Figure 3:
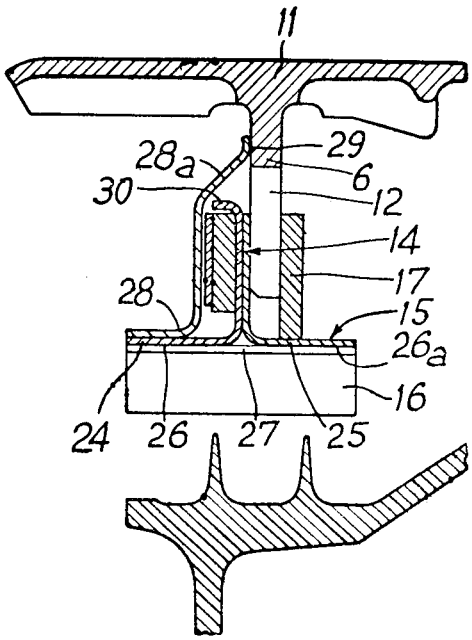
FIG. 3 is a view in axial section of the fastening device taken on the line 3—3 of FIG. 4.
Figure 2:
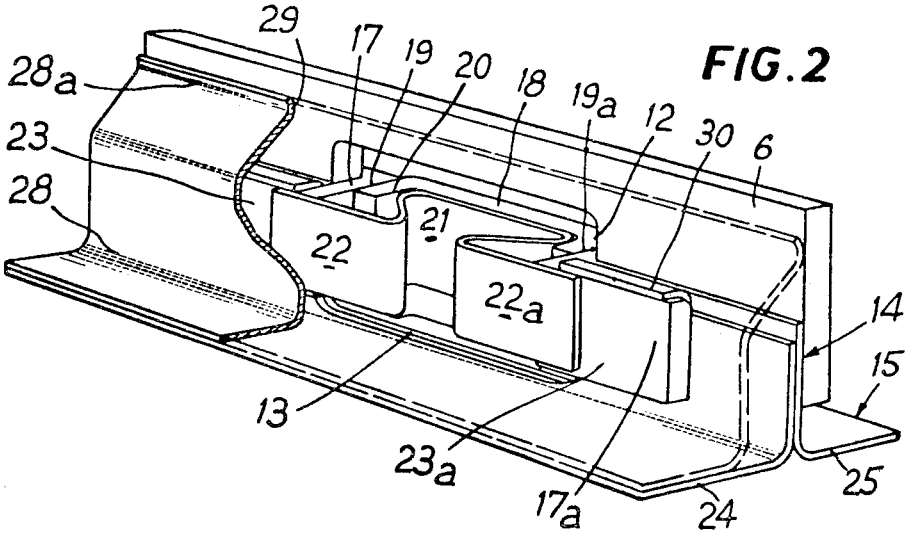
FIG. 2 is a perspective view of an embodiment of a fastening device of a seal according to the invention.
Figure 4:
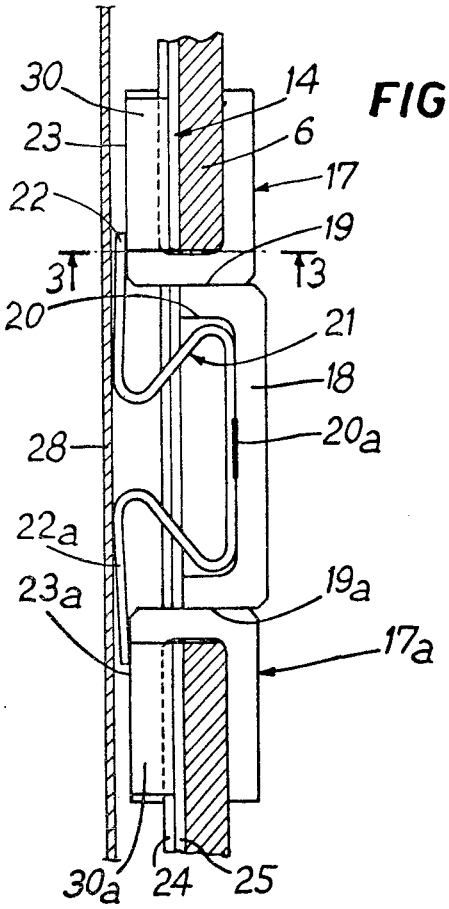
FIG. 4 is a top view of the fastening device of FIG. 2 with parts shown in sections.

According to the embodiment shown in FIGS. 2, 3 and 4, the ring 15 carrying the seals 16, consists of two sheet metal ferrules 24, 25, each of L-shape in cross section, assembled by one of their faces to form a T section comprising a radial wing 14 and two circumferential wings with faces 26, 26*a* against which a circular plate 27 made of sheet metal is secured, said circular plate carrying the seal 16.

A sheet metal packing cover 28 is fastened to the circumferential wing of the ferrule 24, facing the wings 22, 22*a* of the fastener 21 and having a folded border 28*a* which rests with its end 29 against the flange 6 of the distributor and which applies a certain prestress on said flange.

The sheet cover 28, in addition to its sealing effect effectively ensures the elastic retention of the clips 17, 17*a* and of the fastener 21, the wings 22, 22*a* of which abut against said sheet cover (FIG. 4), thus making force mounting of the clips 17, 17*a* unnecessary; such a mounting would considerably hinder the free movements in the radial direction of the ring 15 with respect to the inner flange assembly of the guide vanes (FIG. 4). To assure the radial retention of the clips 17, 17*a*, a folded edge 30 of the ferrule 24 rests against one of the faces of the clips.

Figure 5:
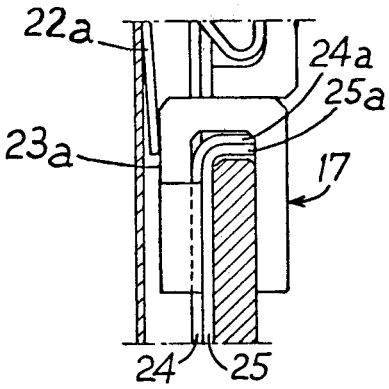
FIG. 5 is a top view of another embodiment of the device according to the invention.
Figure 6:
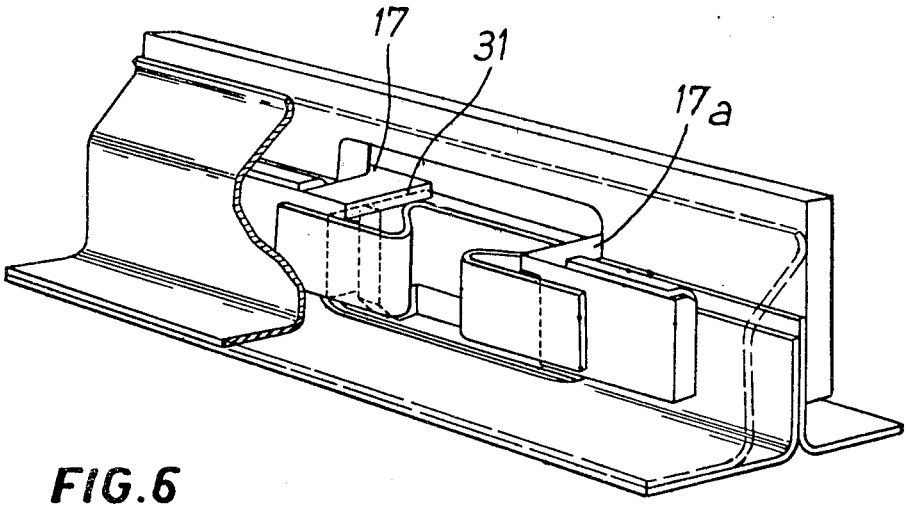
FIGS. 6 and 7 are perspective views showing other embodiments of the clips.
Figure 7:
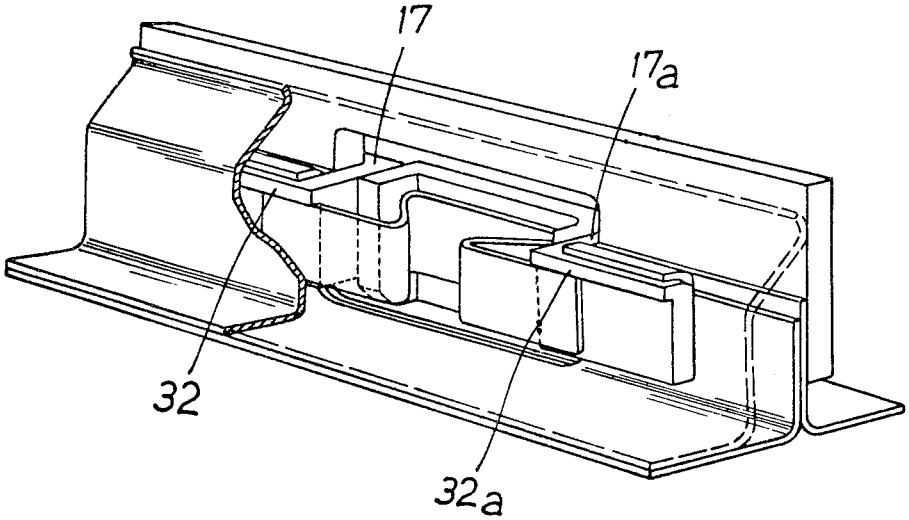

In FIG. 5, another embodiment is shown wherein the cutouts 13 of the ferrules 24, 25 are provided with the folded edges 24*a*, 25*a* ensuring the direct self-centering of the ring 15 carrying the seal, on the flange 6 of the guide vanes. The radial movement of the locking device 18 is very limited by the presence of the inclined part of the sealing cover 28, because the movements of the locking device are effectively linked to the free space existing between the apex of the wings 22, 22*a* of the fastener 21 and the inclined plane 28*a* of the sheet 28. This fastening device may require, under certain conditions, a more rigorous restraint of the radial displacement of the locking device 18. It is possible to provide (FIG. 6) on the upper part of the back of the clips 17, 17*a*, a projection 31 constituting a means for arresting the radial movement of the locking device 18 at the level of the upper part of its lateral faces. On the upper part of the small side of the clips 17, 17*a*, it is also possible to provide a projection 32 (FIG. 7) constituting a means for arresting the radial movement of the locking device 18 at the level of the wings 22, 22*a* of the fastener 21.

To assemble the fastening device of the invention, the cutouts 12 of the flange 6 and the cutouts 13 of the radial flange 14 of the ring 15 carrying the seal are aligned and the clips 17, 17*a* are introduced into said cutouts. Subsequently, the wings 22, 22*a* of the fastener are compressed and the locking device 18 is introduced between the clips into the cutouts 12 and 13. When the wings 22, 22*a* of the fastener 21 expand between the sealing cover 28 and the clips 17, 17*a*, the assembly is locked. The assembly constituted in this manner, because of its fastening of the sectors of the guide vanes, ensures the self-centering of the ring carrying the seal with respect to the entirety of the sectors.

It should be understood that various modifications may be applied by those skilled in the art to the devices or processes described hereinabove merely as nonlimiting examples, without exceeding the scope of the invention as defined by the following claims.

What is claimed is:

1. In a device to fasten a seal on guide vanes of a turbine engine consisting of sectors, each of which comprises a plurality of blades and having a radial inner flange upon which a ring carrying a seal is secured, the improvement wherein the ring carrying the seal has a radial wing resting against said inner flange and is provided with cutouts arranged so as to coincide with corresponding cutouts provided on the flange, wherein U shaped clips are engaged securing, along the opposing edges of the cutouts, the radial wing of the seal ring against the inner flange, said clips being retained in place by a locking device between said clips and resting with its opposite faces against the backs of the clips, retention of the clips in place being ensured by a Ω shaped resilient fastener, engaging and secured in a recess of the locking device and resting with its wings against the lateral faces of the clips.

2. A device according to claim 1, characterized in that the ring carrying the seal comprises two ferrules each being of L-shape in cross section, said ferrules being assembled at one of their faces to form a T profile, a radial wing and two circumferential wings to which a circular plate carrying the seal is fastened, one of the circumferential wings carrying on its side facing the circular plate, a sheet metal cover having a folded edge, the end of said edge resting against the flange of the guide vane and applying a certain prestress on the flange, with the folded edge of the sheet cover functioning as a support for the wings of the resilient Ω fasteners.

3. A device according to claim 2, characterized in that at least one of the ferrules with the L profile constituting the ring carrying the seal has a folded border on one of the faces of the clips.

4. A device according to claim 1 characterized in that the cutouts in the radial wing of the ring have folded edges resting against an edge of the cutout provided in the inner flange of the guide vanes and ensuring the direct self-centering of the seal on the flange of the guide vanes.

5. A device according to claim 1, characterized in that on the upper part of the back of the clips, a projection is provided against which the locking device abuts at the level of the upper part of its lateral faces.

6. A device according to claim 1, wherein the upper part of the small side of the clips there is provided a projection against which the locking device abuts at the level of the Ω fastener.

* * * * *

UNITED STATES PATENT OFFICE

CERTIFICATE OF CORRECTION

Patent No. 4,239,451 Dated December 16, 1980

Inventor(s) MICHEL A. BOURU

It is certified that error appears in the above-identified patent and that said Letters Patent are hereby corrected as shown below:

The Foreign Application Priority Data should read

-- Jun. 1, 1978[FR] France..... 78 16973 --.

Signed and Sealed this

Tenth Day of March 1981

[SEAL]

Attest:

RENE D. TEGTMEYER

Attesting Officer

Acting Commissioner of Patents and Trademarks